US006376790B1

(12) United States Patent
Kawase

(10) Patent No.: US 6,376,790 B1
(45) **Date of Patent: *Apr. 23, 2002**

(54) SLIDE SWITCH

(75) Inventor: Toshihiro Kawase, Aichi (JP)

(73) Assignee: Kabushiki Kaisha Tokai Rika Denki Seisakusho, Aichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,813

(22) Filed: Jul. 24, 1998

(30) Foreign Application Priority Data

Aug. 4, 1997 (JP) ..... 9-223015

(51) Int. Cl.[7] ..... H01H 15/00
(52) U.S. Cl. ..... 200/547; 200/302.1
(58) Field of Search ..... 200/547–550, 200/556, 302.1, 332.2

(56) References Cited

U.S. PATENT DOCUMENTS 2,845,499 A * 7/1958 Brown ..... 200/547 X
3,355,565 A * 11/1967 Daul ..... 200/157
3,739,126 A * 6/1973 Sahrbacker et al. ..... 200/157
3,833,784 A * 9/1974 Bobel et al. ..... 200/547 X
4,152,565 A * 5/1979 Rose ..... 200/291
4,725,809 A * 2/1988 Mizata ..... 338/179
4,871,885 A * 10/1989 Kamada ..... 200/5 H
5,198,793 A * 3/1993 Leveque ..... 200/547 X

* cited by examiner

*Primary Examiner*—Renee Luebke
(74) *Attorney, Agent, or Firm*—Morgan, Lewis & Bockius LLP

(57) ABSTRACT

When an operation knob 6 is operated to slide along a slide operation surface 7, a spacer 4 to which a connection pipe shaft portion 17 has been fitted is slid together with a contact holder 8 connected to the spacer 4 by means of a connection pin 18 so that a slide switch 1 performs switching. Since a fitting chamber 5 for the spacer 4 is molded integrally with a case body 2, it is possible to improve the dimensional accuracy of the fitting chamber 5. In addition, since the outer circumferential wall of the spacer 4 which is an integrally molded member is made be in slide-contact with the inner circumferential wall of the fitting chamber 5, the spacer 4 can be slid smoothly without producing looseness. It is also possible to improve a sense of operation of the operation knob 6.

6 Claims, 2 Drawing Sheets

SLIDE SWITCH

BACKGROUND OF THE INVENTION

1. Field of the Invention

The present invention relates to a slide switch.

2. Related Art

In a conventional slide switch, a case b in which a contact holder a is received slidably, and a case upper cover d provided with an operation knob c so that the operation knob c can be operated to slide are formed separately from each other as shown in FIG. 4. In addition, a fitting chamber g for a spacer f which closes a connecting long hole e formed in the case b is defined by the case b and the case upper cover d. The spacer f is an indispensable part for water proof by operation.

However, in the above-mentioned conventional slide switch, there is such a problem that, since the fitting chamber g for the spacer f is formed by the case b and the case upper cover d, looseness occurs between the fitting chamber g and the spacer f if the dimensional accuracies of both parts are not ensured so that it becomes difficult to make a sliding operation of the spacer f smooth and it becomes difficult to ensure water resistant operation.

The present invention is intended to solve the foregoing problem, and it is an object thereof to provide a slide switch in which the dimensional accuracy of a fitting chamber is ensured to make a sliding operation of a spacer smooth and to ensure water resistant operation.

SUMMARY OF THE INVENTION

In order to relieve the above problem, according to the present invention, there is provided a contact holder received slidably, and a fitting chamber for a spacer which closes a connecting long hole formed in said case molded integrally, a slide operation surface of an operation knob formed on the outer surface of said fitting chamber, and a connection shaft portion formed on said operation knob inserted into said spacer through a sliding long hole formed in said slide operation surface and said connection shaft portion wherein said contact holder are connected to each other by means of a connection pin inserted into said connecting long hole.

According to the above-mentioned slide switch, the fitting chamber for the spacer is molded integrally with the case which receives the contact holder slidably. Accordingly, it is possible to ensure the dimensional accuracy of the fitting chamber, and it is possible to realize a smooth sliding operation of the spacer and maintain a water resistant seal about the connection pin. In addition, the connection shaft portion of the operation knob inserted into the spacer through the sliding long hole formed in the slide operation surface is connected to the contact holder through the connection pin inserted into the connecting long hole formed in the case. Accordingly, a smooth sliding operation of the spacer is ensured, so that there is such an effect that it is also possible to improve a sense of operation of the operation knob.

DETAILED DESCRIPTION OF THE PREFERRED EMBODIMENT

Figure 1:
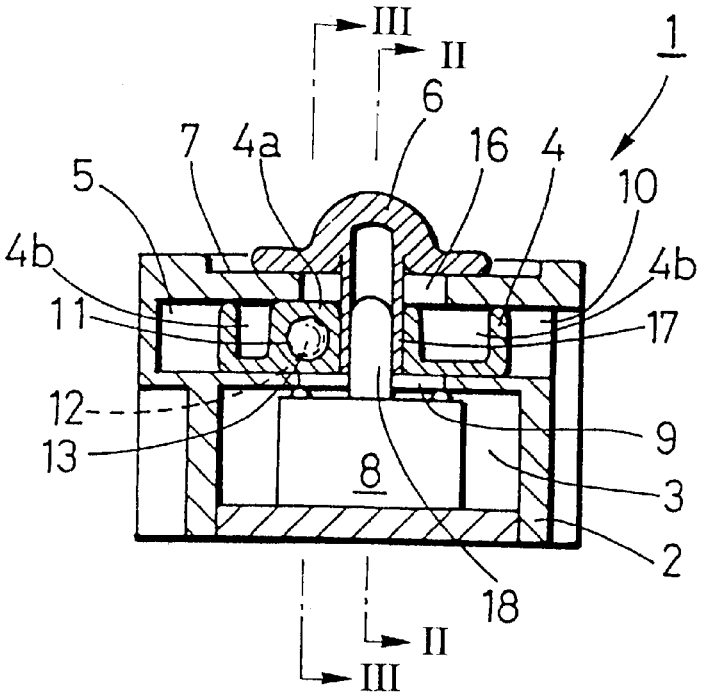
FIG. 1 is a vertical sectional side view of a center portion of a slide switch 1.
Figure 2:
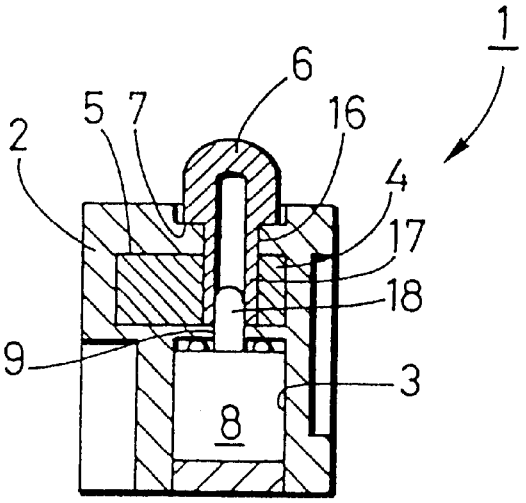
FIG. 2 is a sectional view taken on line II—II FIG. 1.
Figure 3:
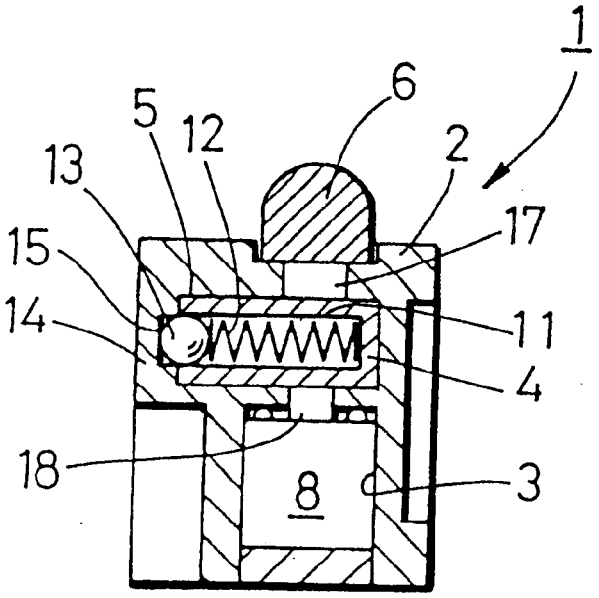
FIG. 3 is a sectional view taken on line III—III in FIG. 1.
Figure 4:
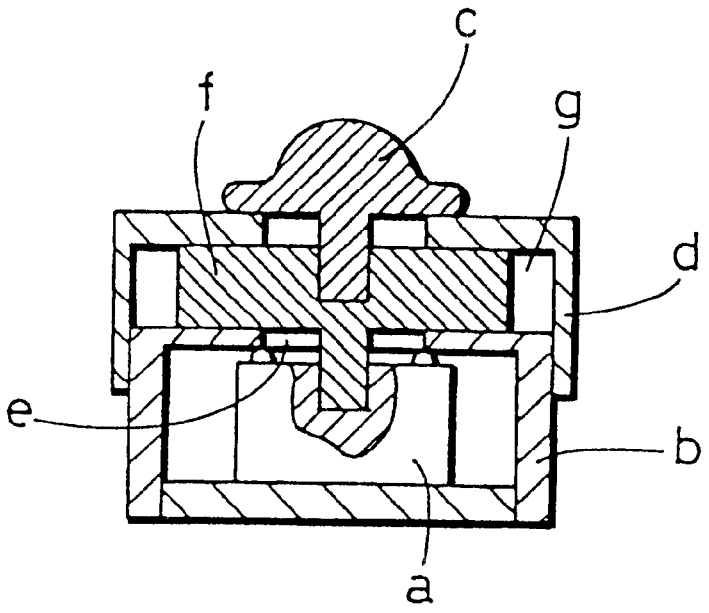
FIG. 4 PRIOR ART
FIG. 4 is a sectional view illustrating a conventional example.

A mode for carrying out the present invention will be described with reference to the accompanying drawings. As shown in FIGS. 1–3, a contact holder chamber 3, a fitting chamber 5 for a spacer 4, and a slide operation surface 7 of an operation knob 6 are defined by an integrally molded case body 2 of the slide switch 1.

A contact holder 8 is slidably fitted into the contact holder chamber 3. A connecting long hole 9 is formed in the upper surface of the contact holder chamber 3. In addition, the fitting chamber 5 for the spacer 4 is formed to be continuous to the contact holder chamber 3 with the upper surface of the contact holder chamber 3 as a bottom of the fitting chamber 5. One of left and right sides of the fitting chamber 5 is opened so as to form an insertion hole 10 for the spacer 4. The spacer 4 is an integrally molded member provided with a solid portion 4*a* formed at its center and rectangular recess portions 4*b* formed on opposite sides of the solid portion 4*a,* the cross-sectional shape of the solid portion being made to be transversely-elongated rectangular. The spacer 4 is inserted into the fitting chamber 5 through the insertion hole 10 so as to be slidable while making the outer circumferential wall of the solid portion 4*a* be in slide-contact with the inner wall of the fitting chamber 5. Therefore, the connecting long hole 9 of the contact holder chamber 3 is entirely closed. In addition, a control portion 14 comprises a control hole 11 formed in a side of the solid portion 4*a,* and a control spring 12 and a is control ball 13 fit in the control hole 11. The control ball 13 fits into one of several control valleys 15. The control valleys 15 are formed at positions corresponding to a neutral position and left and right switching positions of the operation knob 6.

Here, the contact holder may be oriented such that the direction of the slide operation of is substantially parallel to the first and second elongated holes. In this manner, the pipe shaft portion 17 and the connection pin 18 may be slidably disposed through the sliding long hole 16 and the connecting long hole to operate the slide switch 1. In addition, the pipe shaft portion 17 may have a substantially uniform cross section so that the pipe shaft portion 17 can be inserted through the sliding long hole 16 to be connected to the connection pin 18.

A sliding long hole 16 is bored in the slide operation surface 7 provided in the outer surface of the fitting chamber 5. A connection pipe shaft portion 17 formed on the lower surface of the operation knob 6 is inserted through the sliding long hole 16. Then, the pipe shaft portion 17 is fitted to the spacer 4. A connection pin 18 formed integrally with the upper surface of the contact holder 8, and inserted into the connecting long hole 9 of the contact holder chamber 3 is inserted into the connection pipe shaft portion 17 fitted to the spacer 4 so as to be connected therewith.

If the operation knob 6 is operated to slide along the slide operation surface 7, the spacer 4 to which the connection pipe shaft portion 17 has been fitted is slid together with the contact holder 8 connected to the spacer 4 by the connection pin 18 so that the slide switch 1 performs switching. In the switching position, the control ball 13 is caught in the control valley 15 of the control portion 14.

As has been described above, since the fitting chamber 5 for the spacer 4 is molded integrally with the case body 2, it is possible to improve the dimensional accuracy of the fitting chamber 5 as compared with a conventional configuration wherein a fitting chamber defined by a case and a case upper cover that are formed separately. In addition, since the spacer 4 is also an integrally molded member, the spacer 4 can be slid smoothly without producing any looseness when the outer circumferential wall of the spacer 4 is made to be in slide-contact with the inner circumferential wall of the fitting chamber 5. Further, it is also possible to improve a sense of operation of the operation knob 6.

What is claimed is:

1. A slide switch, comprising:

a case having first and second portions respectively defining first and second chambers, the first and second portions of the case being formed as one body, an upper surface of the first chamber defining a first elongated hole;

a surface disposed in the case separating the first and second chambers, the surface defining a second elongated hole parallel to the first elongated hole;

a contact holder accommodated in the second chamber to slide in a direction substantially parallel to the first and second elongated holes;

a pin connected with the contact holder;

a spacer disposed in the first chamber for sealing the second elongated hole, the spacer defining a through hole;

a shaft connected with an operation knob and the pin, wherein the shaft and the pin are collectively interconnected between the contact holder and the operation knob through the through hole to be slidably disposed through the first and second elongated holes and the through hole to move in the direction substantially parallel to the first and second elongated holes to allow operation of the contact holder through the first and second elongated holes.

2. The slide switch according to claim 1, wherein the spacer defines recess portions.

3. The slide switch according to claim 1, wherein the spacer defines rectangular recess portions.

4. The slide switch according to claim 1, further comprising a control portion, the control portion including:

a control ball disposed in a control hole formed in the spacer;

a control spring disposed in the control hole, the control spring biasing the control ball toward an opening of the control hole into contact with a side wall of the case;

at least two recesses formed in the side wall of the case for receiving the control ball, the at least two recesses corresponding to respective switching states of the slide switch.

5. The slide switch according to claim 1, wherein the shaft has a length in a longitudinal direction greater than a width in the direction substantially parallel to the first and second elongated holes.

6. The slide switch according to claim 5, wherein a portion of the shaft between the first and second elongated holes has substantially uniform cross-sectional dimensions.

* * * * *